US010300587B2

(12) United States Patent
Beals et al.

(10) Patent No.: US 10,300,587 B2
(45) Date of Patent: May 28, 2019

(54) CLIP INSTALLATION TOOL

(71) Applicant: Toyota Motor Engineering & Manufacturing North America, Inc., Erlanger, KY (US)

(72) Inventors: Jeremy D. Beals, Georgetown, KY (US); Jeremy L. Fraley, Georgetown, KY (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 679 days.

(21) Appl. No.: 15/015,485

(22) Filed: Feb. 4, 2016

(65) Prior Publication Data

US 2017/0225308 A1 Aug. 10, 2017

(51) Int. Cl.
*B23P 11/00* (2006.01)
*B25B 31/00* (2006.01)

(52) U.S. Cl.
CPC ..... *B25B 31/00* (2013.01)

(58) Field of Classification Search
CPC ..... B23P 11/00; B23P 11/005; B23P 11/027; B23P 19/00; B23P 19/02
See application file for complete search history.

(56) References Cited

U.S. PATENT DOCUMENTS

| | | | | |
|---|---|---|---|---|
| 7,496,993 | B2 | 3/2009 | Kosidlo et al. | |
| 7,837,225 | B2 | 11/2010 | Gosis et al. | |
| 7,976,056 | B2 | 7/2011 | Kirchen et al. | |
| 8,459,695 | B2 | 6/2013 | Spencer et al. | |
| 2009/0228024 | A1* | 9/2009 | Whitfield | A61B 17/1285 606/143 |
| 2010/0217188 | A1* | 8/2010 | Lampropoulos | A61M 25/1018 604/97.03 |
| 2011/0290856 | A1* | 12/2011 | Shelton, IV | A61B 34/30 227/180.1 |
| 2017/0225308 | A1* | 8/2017 | Beals | B25B 31/00 |

FOREIGN PATENT DOCUMENTS

| | | |
|---|---|---|
| EP | 1978430 B1 | 5/2010 |

* cited by examiner

*Primary Examiner* — Lee D Wilson
(74) *Attorney, Agent, or Firm* — Dinsmore & Shohl, LLP

(57) ABSTRACT

Tools for installing a clip having a depressible engagement member are disclosed. In one embodiment, the tool includes a pin and a head both configured to engage the depressible engagement member. A trigger assembly is mechanically coupled to both the pin and the head. The pin is configured to actuate the trigger assembly so as to release the hear, wherein the head may actuate a counting unit so as to register a count when the pin engages the depressible engagement member, informing the installer when a clip is properly installed.

20 Claims, 7 Drawing Sheets

CLIP INSTALLATION TOOL

TECHNICAL FIELD

The present specification generally relates to clip installation tools and, more particularly, clip installation tools configured to provide an accurate count of a properly installed clip.

BACKGROUND

Clips are used to secure a device to a structure. In some instances, a device requires a predetermined number of clips. For instance, five clips may be used to secure a curtain side airbag to a pillar of an automotive vehicle. The curtain side airbag is mounted to the pillar, and the clips are manually set onto predetermined locations of the curtain side airbag. The clip includes a depressible engagement member which may be pushed into the pillar, locking the clip to the pillar and securing the curtain side airbag therebetween.

A tool is used to engage the depressible engagement members into the pillar. Such tools include a counting unit configured to count the number of clips installed. However, in some instances, the tool may count an installation of a clip already installed. For instance, an installer may engage the tool with a clip already installed, thus registering a count. In such instances, the tool may then indicate that the five clips have been installed when only four clips were.

Accordingly, a need exists for a tool configured to install a clip to a structure wherein the tool only counts the number of clips actually installed so as to help ensure that all the requisite clips have been installed.

SUMMARY

In one embodiment, a tool includes a handle. The tool includes a working portion having a head and a pin. The head and the pin are both configured to engage the depressible engagement member. The pin is disposed forward of the head and is slidably mounted to the head, accordingly, the pin engages the depressible engagement member before the head. The depressible engagement member is configured to be pushed into a substrate, securing a device to the substrate.

The tool includes a pair of guides disposed on opposite sides of the head. The guides include a distal end which project forward of the distal end of the pin. Accordingly, the guides prevent the pin from being engaged when the guides abut against a planar surface.

The tool further includes a trigger assembly and a counting unit. The trigger assembly is mechanically coupled to both the pin and the head. Wherein engagement of the pin with the depressible engagement member actuates the trigger assembly. The trigger assembly releases the head. The head is then free to actuate the counting unit.

In one embodiment the depressible engagement member pushes the head into contact with the counting unit. In another embodiment, the counting unit registers a count when the head retreats a predetermined distance within the housing. Accordingly, in instances where the depressible engagement member is already pushed into a substrate, the pin will not actuate the trigger assembly and the trigger assembly holds the head in place so as to prevent the counting unit from registering a count.

In another embodiment, the tool is further configured to prevent an installation of a single clip from being counted more than once. In such the tool may further include a head sensing unit. The head sensing unit is configured to detect the position of the head. The head sensing unit is communication with a processing unit and determines only one count when the head is displaced a predetermined distance. Accordingly, the head sensing unit prevents the occurrence of multiple counts made by inadvertent contact with the counting unit during the installation of a single clip.

BRIEF DESCRIPTION OF THE DRAWINGS

The embodiments set forth in the drawings are illustrative and exemplary in nature and not intended to limit the subject matter defined by the claims. The following description of the illustrative embodiments can be understood when read in conjunction with the following drawings, where like structure is indicated with like reference numerals and in which:

DETAILED DESCRIPTION

Referring generally to the figures, embodiments of the present disclosure are directed to tools and, more particularly, to tools for installing a clip. The tools described herein may be useful in securing a device onto a substrate. As an example and not a limitation, the tools described herein may be utilized to mount a curtain side airbag onto a pillar of an automotive vehicle. The curtain side airbag may require five clips for installation onto the pillar. The tools described herein provide an accurate count for the number of clips installed so as to prevent a single clip from being counted twice, thus notifying the installer that the correct number of clips are installed. In other words, the tool is useful in ensuring all of the requisite clips have been engaged when mounting a device to a substrate.

The tools described herein include a pin and a head. The pin and the head are both configured to engage the depressible engagement member, wherein the depressible engagement member engages the substrate and remains recessed within a clip housing. The pin is further configured to release the head, and the movement of the head is used to register a count. A pair of guides limit the advancement of the tool. The guides have a distal end which extend beyond the distal end of the pin. Thus, the guides prevent the pin from being engaged when the distal ends of the guides abut against a planar surface.

The tool further includes a trigger assembly and a counting unit. The trigger assembly is mechanically coupled to both the pin and the head. The pin actuates the trigger assembly when engaged with the depressible engagement member. The actuation of the trigger assembly releases the head, allowing the depressible engagement member to push the head towards the handle. The counting unit registers a count when the head moves a predetermined distance towards the handle. In one aspect of the tool, the counting unit registers a count when the head contacts the counting unit.

A processing unit may calculate the total number of counts. Accordingly, the tool provides a count of the total number of times a depressible member is pushed into the substrate, as the guides prevent the pin from engaging a depressible member already pushed into the substrate.

Various embodiments of tools and electronic device assemblies are described in detail herein.

Figure 1B:
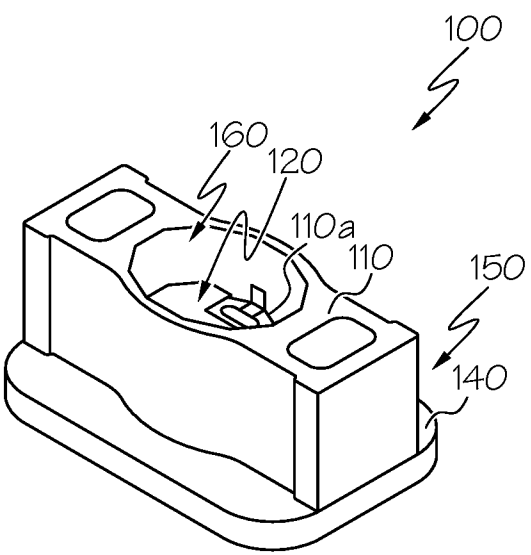
FIG. 1B schematically depicts the clip housing in shown in FIG. 1A in the depressed position.
Figure 1A:
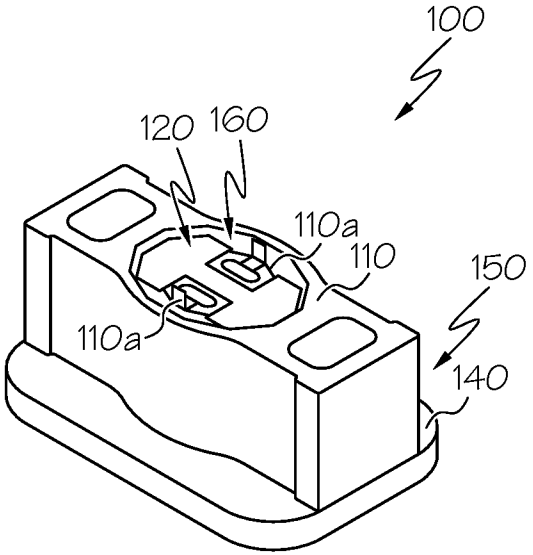
FIG. 1A schematically depicts a perspective view of an example clip housing according to one or more embodiments described and illustrated herein.

Referring now to FIGS. 1A and 1B an example clip 100 for use with the tool 10 is provided. The clip 100 includes a clip housing 110. A depressible engagement member 120 is disposed within the clip housing 110 and is configured to engage a substrate 132. Accordingly, the clip 100 may be used to fix a device (not shown) such as a curtain side airbag to a substrate 132 such as a pillar (not shown) of an automotive vehicle (not shown).

The clip housing 110 includes a base 140 and a body member 152. The body member 152 is a generally rectangular block. The base 140 is generally planar. The body member 152 is fixedly mounted to the base 140 and includes a cavity 160. The depressible engagement member 120 is mounted in the cavity 160. The cavity 160 is illustratively shown as having a generally oval shaped cross-section.

FIG. 1A shows the depressible engagement member 120 in a ready position. The depressible engagement member 120 includes a pair of opposing end portions and a neck portion extending between the pair of end portions so as to define respective openings 110*a*. FIG. 1B shows the depressible engagement member 120 in a pressed position. In the ready position, the top surface 120*a* of the depressible engagement member 120 is almost flush with the opening of the cavity 160. In pressed position, the depressible engagement member 120 is recessed within the clip housing 110 relative to the ready position.

Figure 2:
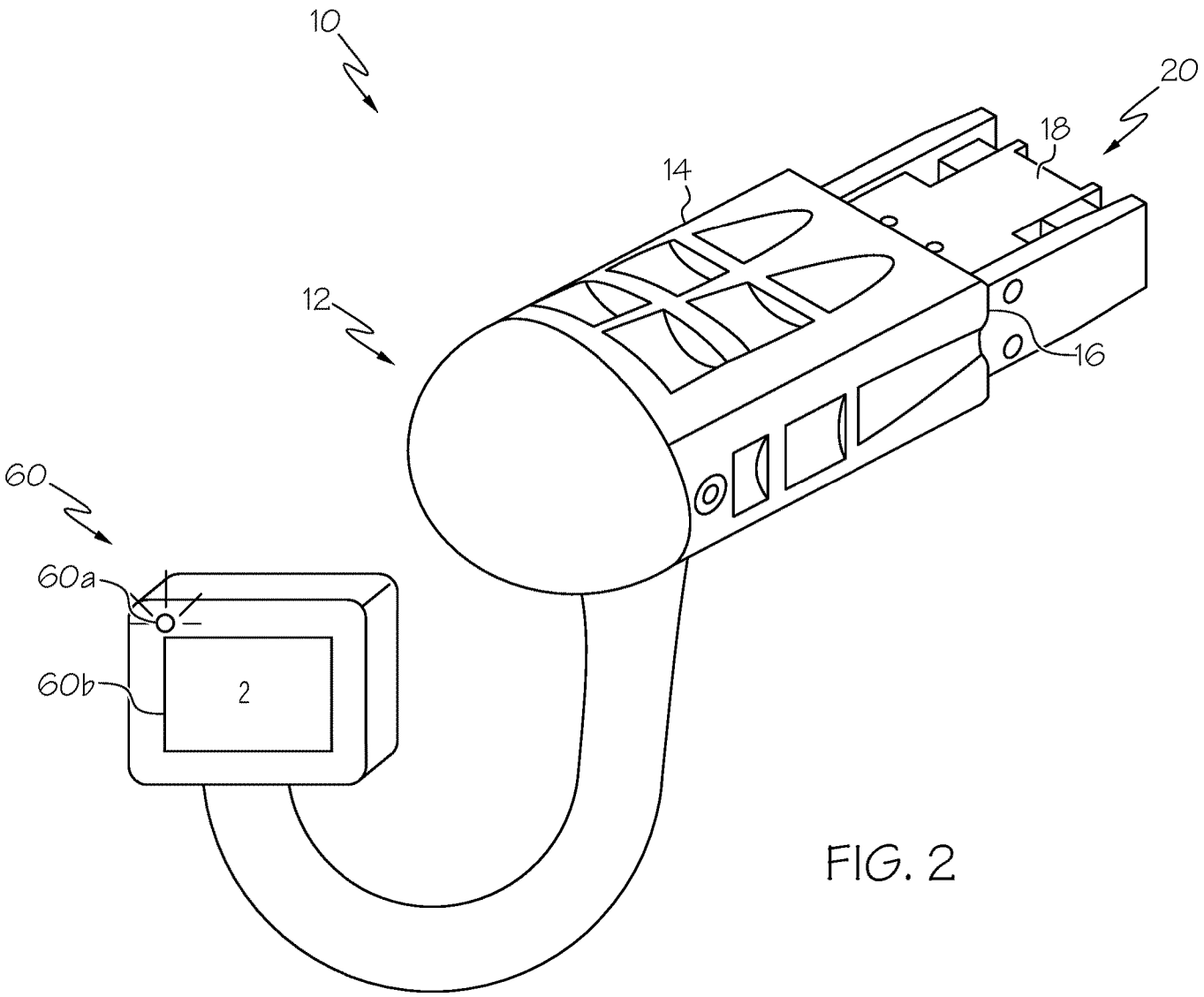
FIG. 2 schematically depicts an example tool according to one or more embodiments described and illustrated herein.

With reference now to FIG. 2 an example tool 10 is schematically depicted in a perspective view. The tool 10 depicted in FIG. 2 generally includes a handle 12 configured to be gripped by an installer. The handle 12 includes a housing 14. The housing 14 includes an opening formed on the distal end of the housing 14. A casing 18 is mounted to opening of the housing 14. The head 20 is slidably mounted to the casing 18 so as to retreat into the casing when pressed.

Figure 3:
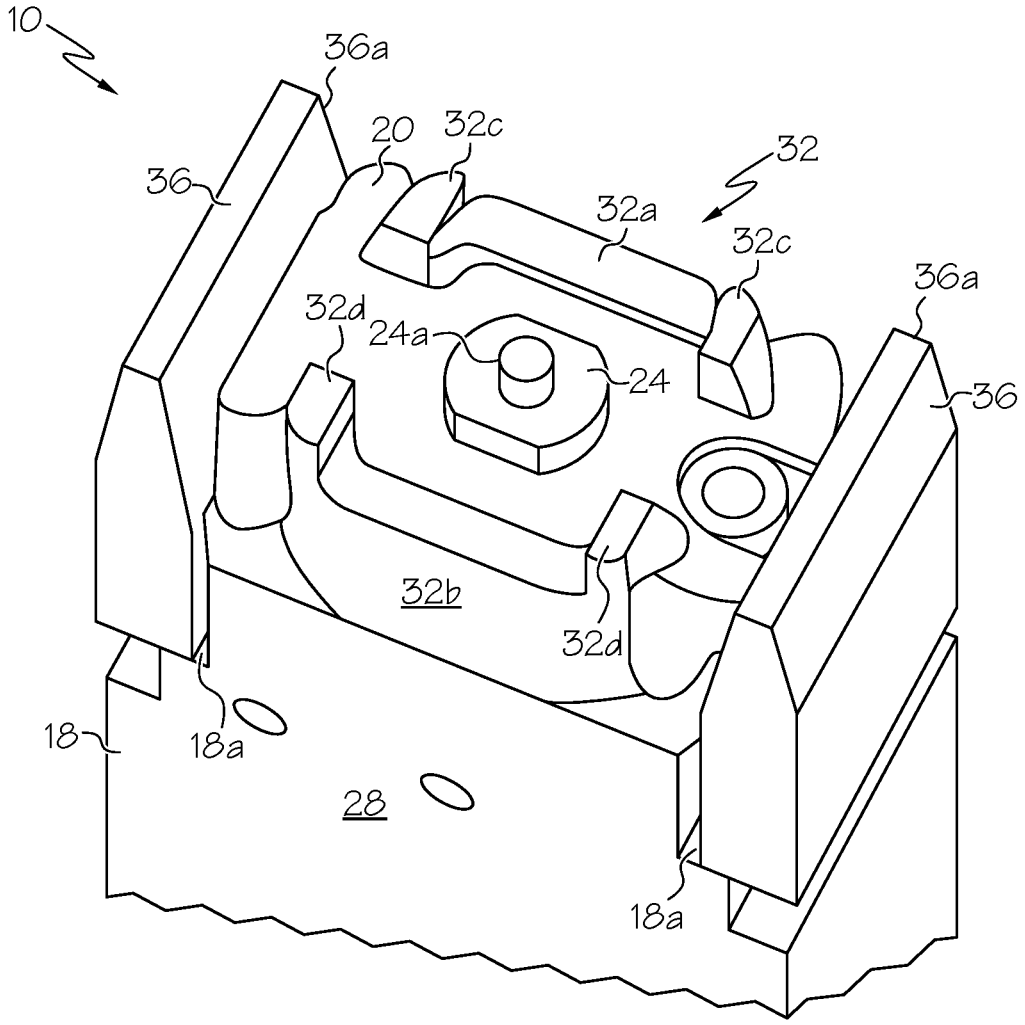
FIG. 3 schematically depicts the working end portion of the tool shown in FIG. 2.

With reference now to FIG. 3 a perspective view of the working portion of the tool 10 shown in FIG. 2 is provided. The working portion of the tool 10 includes a head 20. The head 20 is supported by the casing 18. The head 20 is a block member having a cylindrical sleeve 24 generally centered on the head 20. The cylindrical sleeve 24 defines a bore 24*a*. A pin 26 is slidably mounted within the bore 24*a*. A portion of the pin 26 projects forward of the head 20.

The casing 18 is configured to support the head 20. The casing 18 includes a body portion 28 having a central opening 30 configured to accommodate the head 20. The body portion 28 is fixedly mounted to the opening 16 of the housing 14.

The casing 18 further includes a support portion 32 formed on a distal end of the body portion 28. The head 20 is slidably mounted to the support portion 32. The support portion 32 includes a pair of walls 32*a*, 32*b* spaced apart from each other. Each wall 32*a*, 32*b* includes a pair of arms 32*c*, 32*d* are received within respective slots 34*a*, 34*b* of the head 20. A first biasing member 22 (shown in FIG. 4) is operatively connected to the head 20 and an inner wall portion 32*f* (shown in FIG. 4) of the support portion 32 so as to continuously urge the head 20 towards the distal end of the tool 10. The first biasing member 22 may be a helical spring.

The casing 18 further includes a pair of guides 36. The guides 36 are disposed on opposite sides of the casing 18. The guides 36 are spaced apart from each other so as to engage opposite inner surfaces of the clip housing 110. Each guide 36 is symmetrical to the other.

The guides 36 include a tapered end portion 36*a*. The base of the guides 36 are fixedly mounted to a respective ledge portion 18*a* of the casing 18. The head 20 is disposed between the guides 36 and may be recessed with respect to a plane defined by the distal ends of the guides 36. The guides 36 have a longitudinal length configured to stop the pin 26 from engaging the depressible engagement member 120, when the depressible engagement member 120 is in the pressed position.

Figure 4:
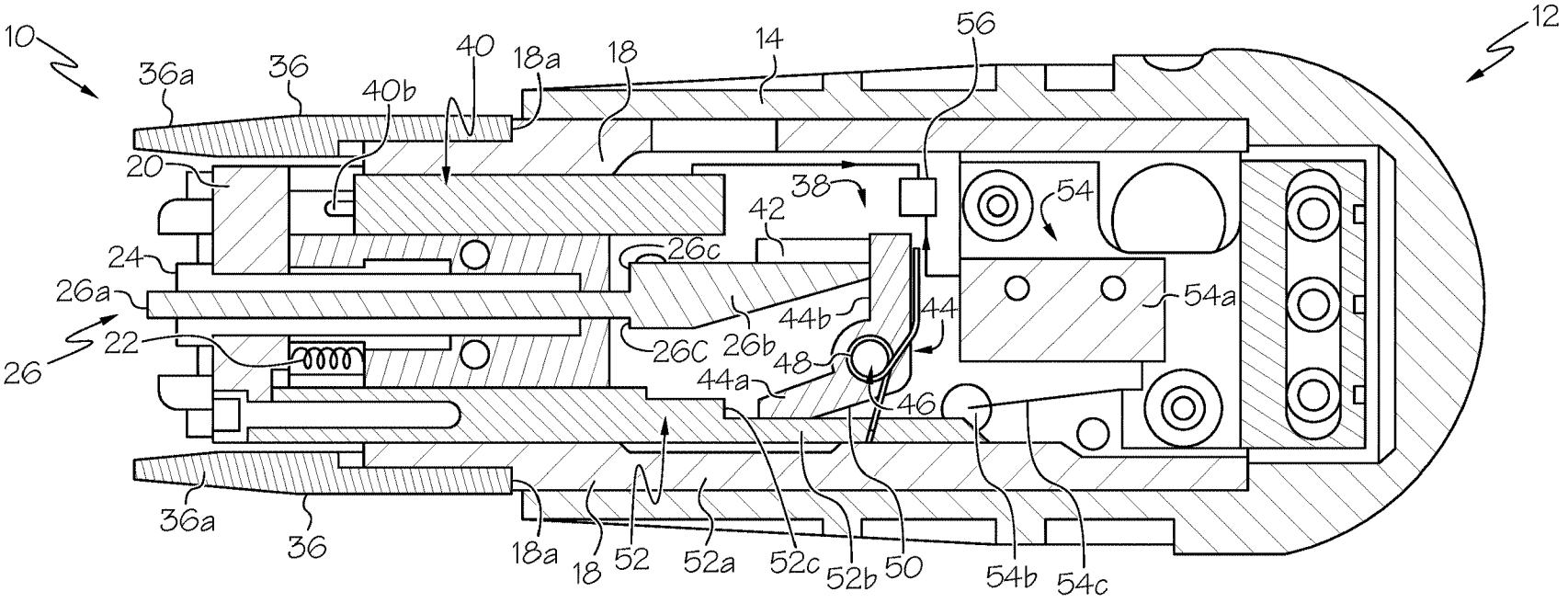
FIG. 4 is a cross-sectional view of the FIG. 2 taken along lines 4-4.
Figure 5:
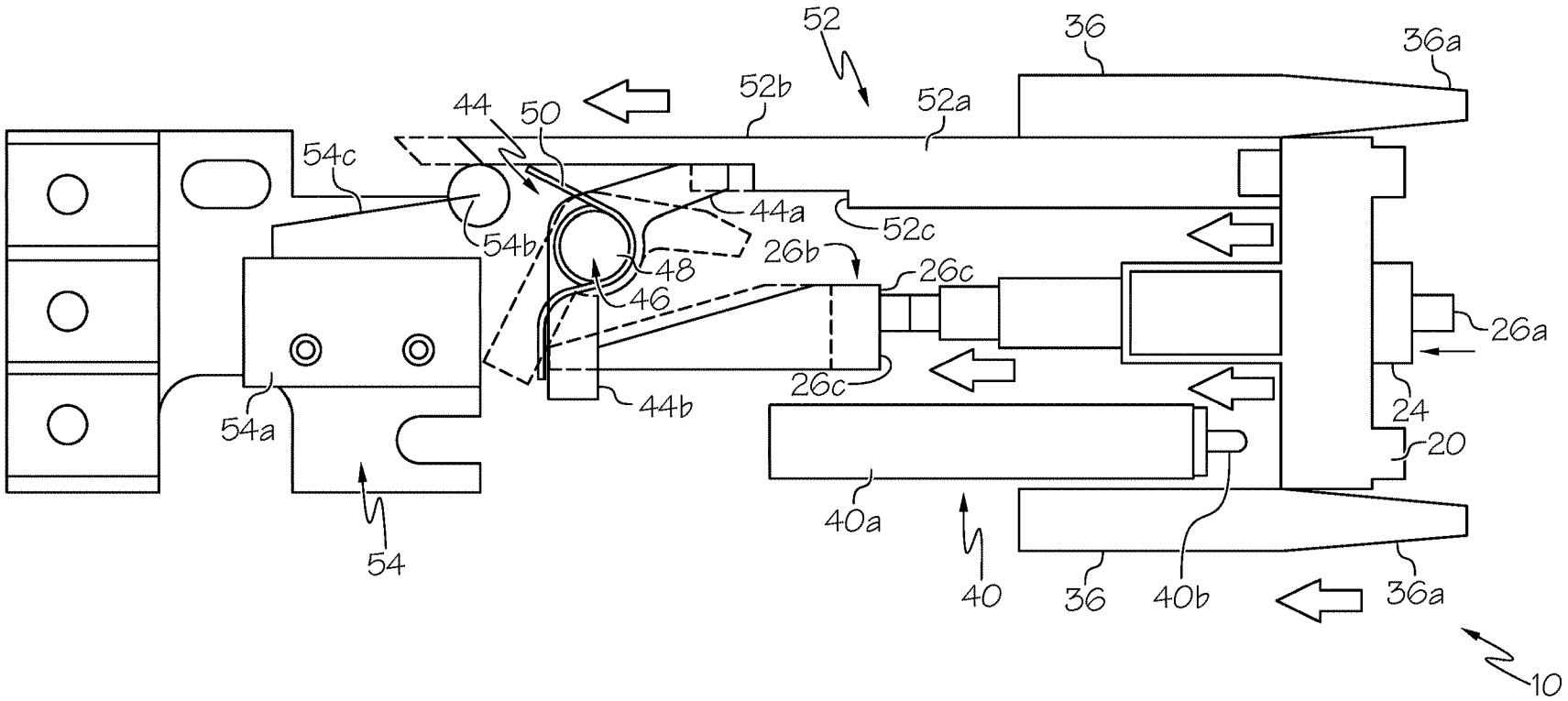
FIG. 5 is an isolated view of an example of the trigger assembly in the engaged position and the disengaged position.

FIG. 4 is a cross-sectional view of FIG. 3 taken along lines 4-4. FIG. 4 provides an illustrative example of a trigger assembly 38, the pin 26 and a counting unit 40. A proximal end portion 26*a* of the pin 26 is shown extending beyond the outer surface of the bore 24*a*. A distal end portion 26*b* of the pin 26 is engaged with the trigger assembly 38. The pin 26 is a generally elongated member and may have a cylindrical body.

A distal end portion 26*b* of the pin 26 is illustratively shown as having a ramp shaped cross-section. The distal end portion 26*b* of the pin 26 is defined by a pair of shoulders 26*c* which limit the advancement of the distal end portion pin 26 into the bore 24*a*. An inner wall 42 fixedly mounted to an inner surface of the casing 18 guides the axial displacement of the distal end portion 26*b* of the pin 26. The inner wall 42 is a generally planar member having a longitudinal axis commensurate with a desired path of travel of the pin 26.

The trigger assembly 38 may be disposed within the housing 14. The trigger assembly 38 is mechanically coupled to the pin 26. In particular, the trigger assembly 38 may be mechanically coupled to the distal end portion 26*b* of the pin 26. The trigger assembly 38 is movable between an engaged position and a disengaged position and continuously urges the proximal end portion 26*a* of the pin 26 away from the head 20.

An illustrative example of a trigger assembly 38 includes a lever 44 pivotable about a first pivot point 46. The lever 44 is shown generally shaped like a boomerang. The lever 44 includes a first lever member 44*a* angled with respect to a second lever member 44*b*. A first pivot pin 48 pivotably connects the lever 44 to a portion of the housing 14 about the first pivot point 46. The lever 44 moves between the disengaged position and the engaged position. A second biasing member 50 is operatively attached to the lever 44 so as to continuously urge the lever 44 into the disengaged position wherein the head 20 is disengaged from the counting unit 40.

The counting unit 40 is configured to count the number of times the pin 26 engages the depressible engagement member 120. The counting unit 40 may be fixedly disposed within the casing 18. In an illustrative example of a counting unit 40 shown in FIG. 3, the counting unit 40 is a device 40*a* with a button 40*b*. The button 40*b* is spaced a predetermined distance from an interior surface of the head 20. Wherein displacement of the head 20 into engagement with the button registers a count. Any such device may be adapted for use herein, illustratively including a device commonly referenced as a contact switch, MSTKD-B sold by Misumi®.

It should be further appreciated that other counting units 40 currently known and used in the art may be adapted for use herein. For example, the counting unit 40 may be an infrared sensor and a first processor. The infrared sensor may be configured to detect the distance between the back surface of the head 20 and the infrared sensor, wherein the first processor processes the distance and determines a count when the distance is beneath a predetermined threshold.

FIG. 4 also provides an illustrative view of a slide 52. The slide 52 is fixedly mounted to the head 20. The slide 52 is mechanically coupled to the trigger assembly 38. The slide 52 works with the trigger assembly 38 to control the movement of the head 20. The slide 52 is an elongated member 52*a*. The slide 52 includes an end portion 52*b* which is thinner in dimension that the remainder of the elongated member so as to define a catch 52*c*. The catch 52*c* is configured to engage the lever 44. The catch 52*c* works in cooperation with the lever 44, wherein in the engaged position, the lever 44 engages the catch 52*c* so as to prevent the head 20 from retreating into the casing 18 and engaging the counting unit 40.

Referring again to FIG. 4 an example tool 10 may further include a head sensing unit 54 and a processing unit 56. The head sensing unit 54 may be disposed within the handle 12. The head sensing unit 54 is configured to detect the movement of the head 20. The head sensing unit 54 is illustratively shown as a limit switch 54*a*. Any limit switch currently in use may be adapted for use herein, illustratively including a hinge roller lever 44 switch commonly referred to as SS-5GL2, sold by OMRON®.

The limit switch 54*a* includes a roller 54*b* mounted on a lever arm 54*c*. The roller 54*b* is mechanically coupled to the slide 52. The limit switch 54*a* includes a first processor 54*c* configured to process the rotation of the roller 54*b* into a distance travelled by the slide 52. The limit switch is in communication with the processing unit 56. The processing unit 56 processes the distance traveled by the slide 52 along with any counts determined by the counting unit 40 so as to register a single count when the head sensing unit 54 detects the slide 52 has moved a predetermined distance.

The processing unit 56 may be written onto an electronic circuit board in electrical communication with the head sensing unit 54 and the counting unit 40. The processing unit 56 may be programmed with a predetermined number of counts. The processing unit 56 may include any processing component configured to receive and execute instructions. Alternatively, the tool 10 may include a data storage component 58.

It should be understood that the data storage component 58 may reside local to and/or remote from the tool 10, and may be configured to store one or more pieces of data for access by the processing unit 56. The data storage component 58 may store device data, which may include data regarding the number of clips 100 required to secure the device, and the distance of travel of the head 20 to register a count.

The processing unit 56 may be configured to transmit a signal to a display 60 when the processing unit 56 calculates the adds up each count. The display 60 may be a light 60*a* which is illuminated when the processing unit 56 calculates the predetermined number of counts has been reached. Alternatively, the display 60 may be a screen 60*b* configured to provide a numerical representation of the count. The processing unit 56 may be further configured to reset the count, or zero the count, when the predetermined number of counts is reached.

The tool 10 may be formed of a durable and rigid material, such as steel, configured to maintain its shape with under a load commensurate with the load required to push the depressible engagement member 120. It should be appreciated that the handle may be formed of a resilient material such as a polypropylene or may be formed of a steel and have a resilient cover so as to help facilitate the grip of an installer.

The clip housing 110 may be formed of a resilient material such a a polypropylene adaptable for use in an injection molding processes. The material is configured to assist the depressible engagement member form a snap-fit, or pinch-fit engagement with the substrate.

With reference now to FIGS. 1A, 1B, 4, 5 and 7, the operation of the tool 10 is provided. For illustrative purposes an operation of the tool 10 is described in the context of installing a curtain side airbag into a pillar of an automotive vehicle. For illustrative purposes, the curtain side airbag requires five clips 100 for proper installation. The clips 100 are manually placed in respective openings of the curtain side airbag, and the tool 10 is used to attach the curtain side airbag to the pillar. The clips 100 are initially seated within a respective opening of the curtain side airbag and the depressible engagement member 120 is in the ready position, as shown in FIG. 1A.

Figure 6:
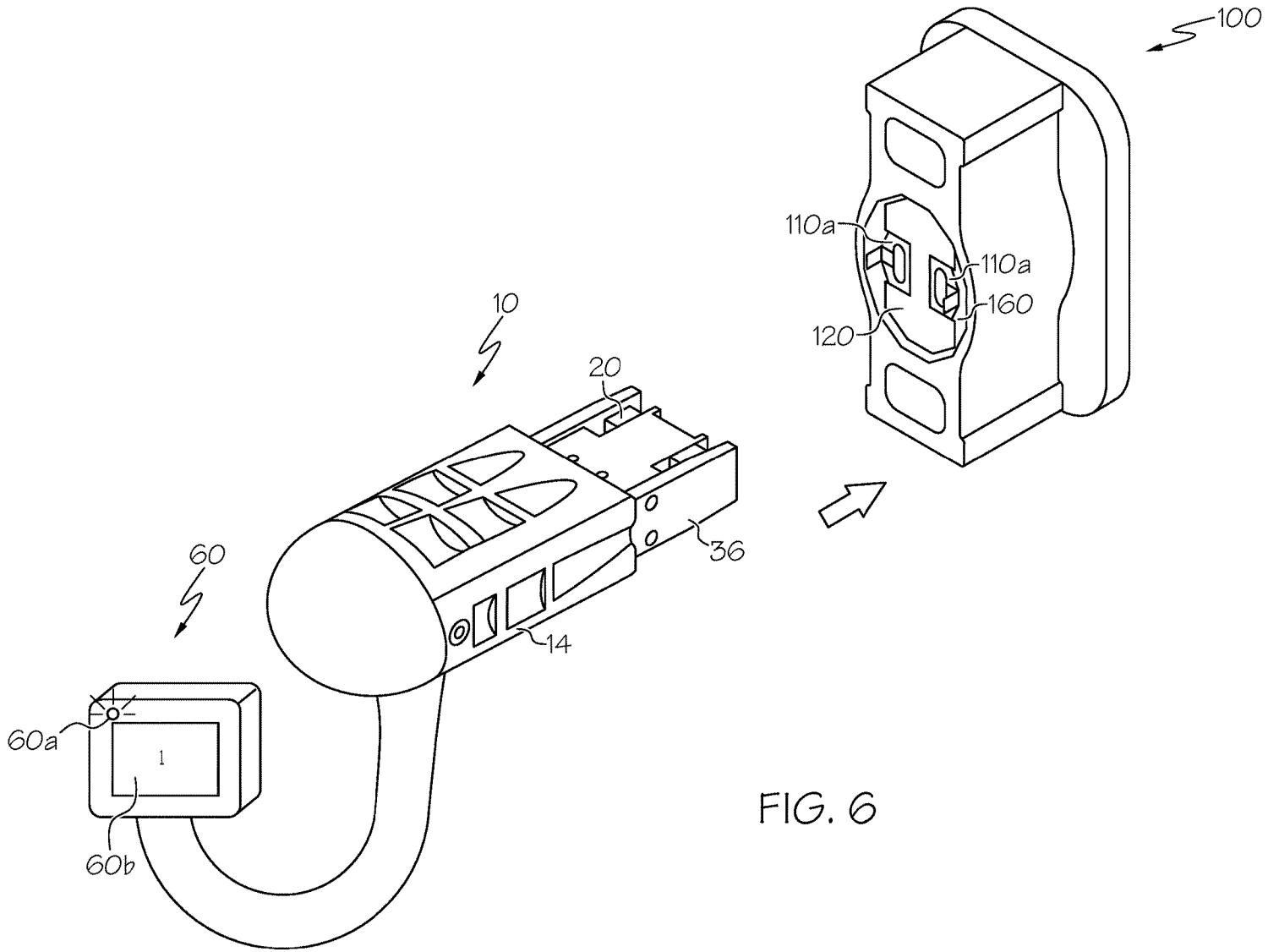
FIG. 6 schematically depicts the tool according to one or more embodiments described and illustrated herein positioned to engage the clip housing according to one or more embodiments described and illustrated herein.

The installer grips the handle 12 and engages the head 20 of the tool 10 into the clip housing 110 as indicated in FIG. 6. Prior to engaging the depressible engagement member 120, the pin 26 is in the extended position as shown in FIG. 4. The guides 36 are positioned within respective openings 110*a* of the clip housing 110. Wherein the pin 26 initially engages the depressible engagement member 120. As the pin 26 engages the depressible engagement member 120, the pin 26 is pushed back, retracting into the casing 18 as shown in dashed lines in FIG. 5.

As the depressible engagement member 120 engages the pin 26, the pin 26 is pushed back into the casing 18. The distal end portion 26*b* of the pin 26 engages the second lever member 44*b*. The biasing force of the second biasing member 50 is overcome, pivoting the lever 44 from the disengaged position to the engaged position, wherein the first lever member 44*a* rotates clear of the catch 52*c* of the slide 52. As the slide 52 is clear of the lever 44, the slide 52 is free to advance into the housing 14.

As the slide 52 is fixedly mounted to the head 20, the head 20 is free to advance into the housing 14 by engagement with the depressible engagement member 120. The back surface of the head 20 engages the counting unit 40 so as to register a count. The count is transmitted to the processing unit 56 which stores the count. Thus, the tool 10 provides a count for each of the depressible engagement member 120 pushed into engagement with the pillar 132*a*.

When the tool 10 is removed from the clip housing 110, the second biasing member is free to urge the lever 44 into the disengaged position, wherein the second lever 44 pushes the pin 26 away from the handle 12, and the first biasing member 22 urges the head 20 upwardly into the support portion 32 of the casing 18, wherein the catch 52*c* advances forward of the catch 52*c* and the first lever 44*a* is urged against the end portion of the slide 52, as shown in FIG. 4.

It should be appreciated that a tool 10 engaged with a clip 100 having a depressible engagement member 120 in the pressed position will not register a count. In such an instance, the guides 36 abut against the bottom surface of the clip housing 110. As the guides 36 extend beyond the proximal end of the pin 26, the pin 26 will not contact the depressible engagement member. Accordingly, a count is not registered and thus, the tool 10 informs the installer that the requisite number of clips 100 have not been installed. The tool 10 may inform the installer by displaying the count on a screen or actuating a light as described above. The tool 10 may be further configured to notify the installer when the predetermined number of counts has been reached wherein the installer may proceed with the installation of another curtain side airbag 140*a*.

In instances where the tool 10 includes a head sensing unit 54, the tool 10 is configured to prevent an occurrence where a single installation is counted twice. For instance, the clip 100 may be mounted on an area difficult to reach. In such instance, the installer may have to wiggle the tool 10 into the clip housing 110 to fully engage the depressible engagement member 120. While wiggling the tool 10, the head 20 may inadvertently contact the counting unit 40 more than one time, registering a count for each time the head 20 touches the counting unit 40.

Figure 7:
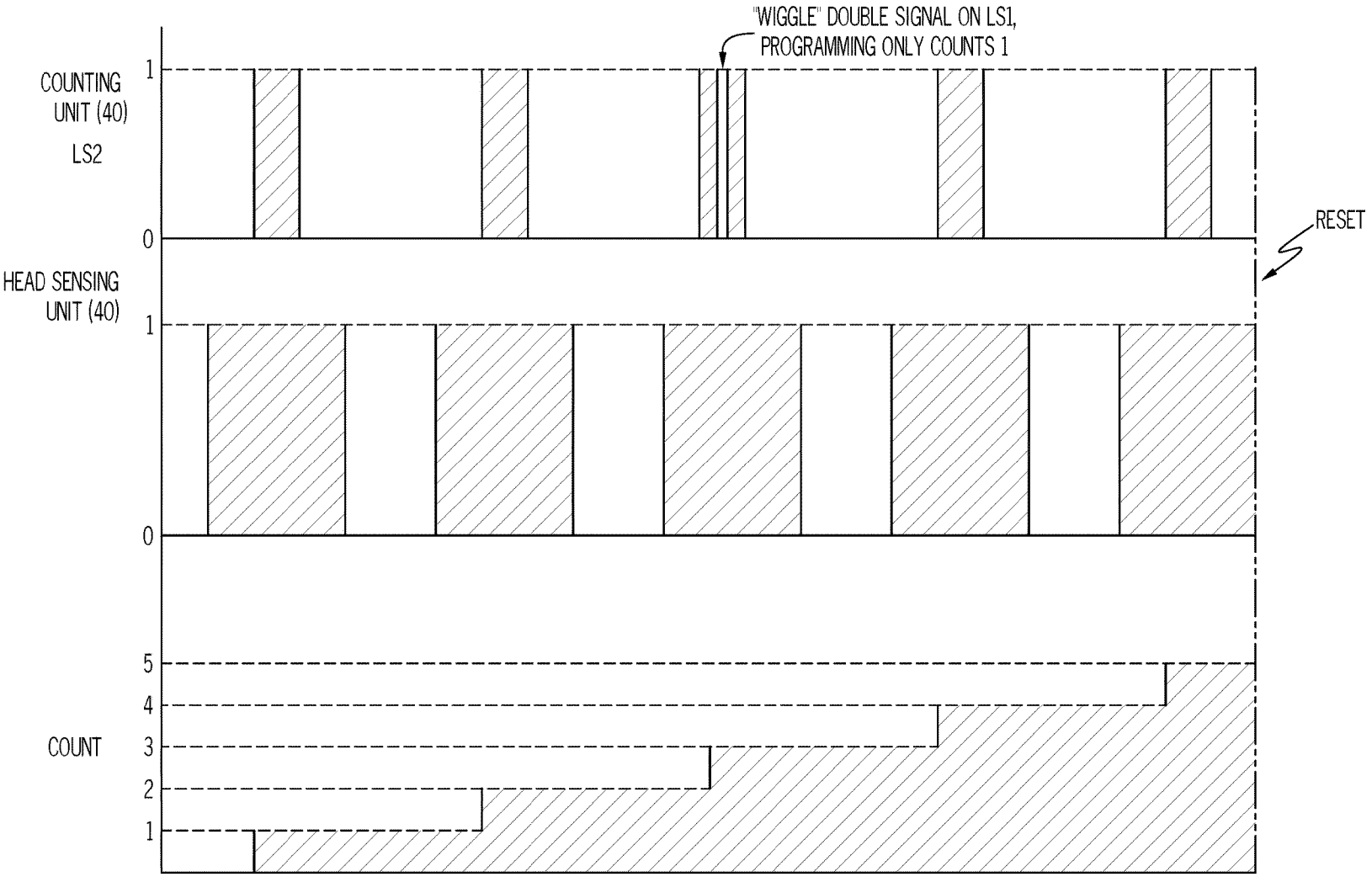
FIG. 7 is a graphical representation of the function of the head sensing unit according to one or more embodiments described and illustrated herein.

Accordingly, the head sensing unit 54 is configured to detect the movement of the head 20 by measuring the distance of the slide 52. FIG. 7 shows a graphical representation of the phenomena. The contact between the head 20 and the counting unit 40 is shown at the top of the graphical representation, and the measurement of the head 20 unit is shown in the middle, and the number of counts registered by the processing unit 56 is provided at the bottom of the graph.

The head sensing unit 54 is configured to directly detect the movement of the slide 52. As the slide 52 is fixedly mounted to the head 20, the head sensing unit 54 also detects the movement of the head 20. The head sensing unit 54 transmits a movement of the head 20 to the processing unit 56. Upon detecting the head 20 moves a predetermined distance, the processing unit 56 processes each count registered by the counting unit 40 as a single count.

The processing unit 56 is programmed with a predetermined number of counts amounting to five (5). The first and second installation of the clips 100 show an instance where only a single count is registered by the counting unit 40. The third installation shows the counting unit 40 registering two counts. However, the processing unit 56 only counts one as the two counts are made when the head 20 has not moved beyond a predetermined distance. Accordingly, the tool 10 provides an accurate count of the number of times a clip 100 has been properly installed.

It should now be understood that embodiments described herein are directed to a tool 10 configured to assist an installer properly install the correct number of clips 100 to a device. In particular, the tool 10 provides installers with notice that each clip 100 of a device is properly installed so that the installer does not move onto another installation. In one aspect of the tool 10, the tool 10 prevents the installer from counting an installation of an already installed clip 100. In another aspect of the tool 10, the tool 10 prevents the installation of a clip 100 from registering more than one count.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A tool for installing a clip having a depressible engagement member, the tool comprising:

a handle including a housing;

a head defining a bore, the head mounted to a distal end of the housing;

a pin configured to engage the depressible engagement member, the pin slidably mounted within the bore;

a trigger assembly disposed within the housing, the trigger assembly mechanically coupled to the pin and to the head, the pin actuating the trigger assembly when engaged with the depressible engagement member; and a counting unit that provides a count when the pin engages the trigger assembly releasing the head so as to allow the head to actuate the counting unit, the counting unit counting a number of clips installed.

2. The tool of claim 1, further including a head sensing unit, the head sensing unit configured to detect a movement of the head, the counting unit further configured to register the count when the head sensing unit detects that the head has moved a predetermined distance.

3. The tool of claim 2, wherein the head sensing unit comprises a limit switch.

4. The tool of claim 1, further including a first biasing member configured to continuously urge the head towards a distal end of the tool.

5. The tool of claim 1, wherein the trigger assembly is pivotably mounted to a first pivot point to pivot between a disengaged position and an engaged position, wherein in the engaged position the trigger assembly releases the head to allow the head to actuate the counting unit.

6. The tool of claim 5, wherein the trigger assembly further includes a lever having a first lever member angled with respect to a second lever member.

7. The tool of claim 6, wherein the trigger assembly further includes a second biasing member, the second biasing member configured to continuously urge the lever into the disengaged position.

8. The tool of claim 6, further including a slide, the slide mechanically coupled to the trigger assembly, the slide fixedly mounted to the head.

9. The tool of claim 8, wherein the slide includes a catch, the catch configured to engage the lever to prevent the head from actuating the counting unit.

10. The tool of claim 1, further including a processing unit, the processing unit receiving the count from the counting unit and processing the count to detect a predetermined number of counts.

11. The tool of claim 10, further including a display, the processing unit actuating the display when the predetermined count is detected.

12. The tool of claim 11, wherein the display is a screen configured to provide a numerical representation of the count.

13. A tool for installing a clip having a depressible engagement member, the tool comprising:

a handle;

a head defining a bore, the head mounted to a distal end of the handle;

a pin configured to engage the depressible engagement member, the pin slidably mounted within the bore;

a first biasing member configured to urge the head away from the handle;

a trigger assembly mechanically coupled to the pin and the head, the trigger assembly including a lever and a second biasing member, the trigger assembly pivotably mounted to a first pivot point to pivot between a disengaged position and an engaged position, in the disengaged position, the lever urges the pin away from the handle and prevents the head from retreating towards the handle and in the engaged position, the pin actuates the lever to disengage the lever from the head;

a counting unit that detects a movement of the head and provides a count when the head moves a predetermined distance, the counting unit counting a number of clips installed; and a processing unit that receives the count from the counting unit and processes the count to detect a predetermined number of counts.

14. The tool of claim 13, further including a head sensing unit that is configured to detect the movement of the head, the counting unit further configured to register the count when the head sensing unit detects the head has moved the predetermined distance.

15. The tool of claim 14, wherein the head sensing unit comprises a limit switch.

16. The tool of claim 13, further including a pair of guides disposed on opposite ends of the head, the pair of guides configured to guide the pin to the depressible engagement member.

17. The tool of claim 13, wherein the lever includes a first lever member angled with respect to a second lever member.

18. The tool of claim 17, wherein the second biasing member is configured to continuously urge the second lever member against the pin.

19. The tool of claim 18, further including a slide that is fixedly coupled to the head, the slide mechanically coupled to the trigger assembly so as to prevent the head from actuating the counting unit.

20. The tool of claim 19, wherein the slide includes a catch that is configured to engage the lever so as to prevent the head from actuating the counting unit.

* * * * *